US006793537B2

(12) United States Patent
Stefaniu et al.

(10) Patent No.: US 6,793,537 B2
(45) Date of Patent: Sep. 21, 2004

(54) WIRE CONNECTOR ASSEMBLY AND METHOD OF FORMING SAME

(75) Inventors: Michael V. Stefaniu, Lake Zurich, IL (US); John T. Scheitz, Barrington, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 10/331,750

(22) Filed: Dec. 30, 2002

(65) Prior Publication Data

US 2004/0127104 A1 Jul. 1, 2004

(51) Int. Cl.[7] ..... H01R 17/00
(52) U.S. Cl. ..... 439/660
(58) Field of Search ..... 439/660, 357, 439/358, 350–356, 596, 906, 687, 696, 930

(56) References Cited

U.S. PATENT DOCUMENTS 4,702,541 A * 10/1987 Arnold ..... 439/304
4,712,861 A * 12/1987 Lukas et al. ..... 385/58
4,737,118 A * 4/1988 Lockard
4,753,612 A * 6/1988 Betsui ..... 439/596
4,824,383 A * 4/1989 Lemke ..... 439/108
4,842,532 A * 6/1989 Krause
4,913,667 A * 4/1990 Muz ..... 439/733.1
4,979,913 A * 12/1990 Aiello et al.
5,370,552 A * 12/1994 Chishima et al.
5,427,549 A * 6/1995 Smith et al. ..... 439/701
5,494,456 A 2/1996 Kozel et al.
5,674,094 A * 10/1997 Hutchinson, Jr. et al.
5,674,095 A * 10/1997 Tanhehco et al. ..... 439/731
5,697,819 A * 12/1997 Hatagishi ..... 439/752
6,010,369 A * 1/2000 Itabashi et al. ..... 439/660
6,102,728 A * 8/2000 Shinchi ..... 439/397
6,354,878 B1 * 3/2002 Kropa et al. ..... 439/610
6,409,392 B1 * 6/2002 Lampert et al. ..... 385/56
6,475,018 B1 * 11/2002 Huang
6,491,542 B1 * 12/2002 Zerebilov ..... 439/489
6,500,030 B2 * 12/2002 Fischer et al. ..... 439/701
6,554,484 B2 * 4/2003 Lampert et al. ..... 385/70

* cited by examiner

*Primary Examiner*—Ross Gushi
*Assistant Examiner*—Phuongchi Nguyen
(74) *Attorney, Agent, or Firm*—Seyfarth Shaw LLP

(57) ABSTRACT

The present invention provides for a wire plug connector assembly where the individual wires are connectorized by forming a housing around the wires and capturing the terminal metallic potion of the wire by a ferrule which is received within an aperture of a receptacle for providing an electrical connection to a contact mounted therein. The plug may be formed of housing halves which are ultrasonically bonded to each other in order to capture the wires therein. The receptacle includes apertures with contacts which are enclosed at the rear face by hinged flaps in order to seal the rear face of the receptacle.

35 Claims, 5 Drawing Sheets

WIRE CONNECTOR ASSEMBLY AND METHOD OF FORMING SAME

The present invention pertains to a wire connector and in particular a plug housing the wire and a receptacle for receiving the plug therein and providing an electrical connection.

BACKGROUND

Many electrical devices are connected by wires that have an insulator surrounding a majority of the wire and a stripped portion exposing a terminal metallic portion of the wire that provides for an electrical connection. The stripped portion of the wire in some prior devices was received by a wire trap connector having a specially designed contact for receiving a bare stripped end of a wire therein for connection to a host device, such as a ballast for a lighting fixture. The bore of the wire trap connector is formed so that insertion of the wire within the connector, traps the stripped terminal within the connector providing an electrical connection. For example, U.S. Pat. No. 5,494,456 provides for a contact mounted with the wire trap connector housing that engages the wire without being over stressed. Such a wire trap connector also provides for a wire extraction tool inserted within the housing in order to release the wire from within the wire trap connector. Such wire trap connectors work well when it is convenient to maintain the bare wire for connection to the host device. However, maintaining the wires in a bare state may cause the terminal portions of the wires to become bent, frayed or entangled with other wires during transport preventing future intermating. Such damage to the terminal portion of the wires may also degrade the electrical connection between the connector and the wire.

Alternative connection methods include soldering the wire directly to a printed circuit board However this task is timely and also may lead to damage of the exposed terminal portion of the wire. Such a soldering operation does not lend itself to an automated assembly procedure and is difficult to accomplish with a wire harness or a cable with multiple wires.

SUMMARY OF THE INVENTION

In order to overcome some of the above discussed disadvantages, an invention is provided, in an embodiment, providing a combination plug and receptacle assembly comprising a plug having a first housing half and a second housing half for capturing therebetween a wire and insulator. The housing includes a body for capturing the insulator and a ferrule for capturing the wire so that the wire is exposed for electrical connection thereto and a ferrule having a first retention member. A receptacle is provided having an aperture for receiving the plug therein and the aperture extends between a rear face and a front face. A contact is mounted adjacent the aperture and is exposed at the rear face. A hinged flap encloses the aperture at the rear face. A second retention member is adjacent to the aperture for coupling with the first retention member in order to lock the plug within the aperture of the receptacle. In an embodiment, each plug housing half may include a major surface having a channel for receiving the wire and insulator therein. In an embodiment, a bore may be formed in the ferrule and in communication with the channel in order to receive an end of the wire formed at approximately 90° from the wire received in the channel. In an embodiment each housing half may include welding features to enhance the welding of the first half to the second half. In an embodiment, a welding feature may be an energy director for ultrasonically welding the first and second halves.

In an embodiment, the first half may include the body having the ferrule extending therefrom and the second half may include a body corresponding to the body of the first half so that upon mating of the halves, the ferrule protrudes beyond each body and the major surface having the wire mounted in the channel is exposed adjacent the body of the second half. In an embodiment each channel may include a wire receiving portion and an insulator receiving portion wherein the diameter of the insulator receiving portion is greater than the wire receiving portion. In an embodiment., the wire may be crimped between the wire receiving portion and the insulator in order to act as a strain relief for the wire. In an embodiment, the first retention member may include a ramped protrusion. In an embodiment, the second retention member may include a tab so that when the ferrule is inserted in the aperture the protrusion slides past the tab and locks behind the tab, restricting the plug from being removed from the receptacle.

In an embodiment, the flap may include a living hinge connecting it to the rear face. In an embodiment, the flap may include fingers for engaging bumps on the rear face in order to lock the flap in a closed and sealed position. In an embodiment, the contact may be stamped and formed having a right angle tail protruding through a passage in the receptacle so that the receptacle may be through-hole mounted to a host substrate. In an embodiment, the host substrate may include liquid pitch disbursed therein and the flap sealing the aperture from the pitch. In an embodiment, the plug may include a ridge formed on the body to abut the front face when the plug is inserted in the receptacle. In an embodiment, the plug may include a plurality of ferrules for receiving a plurality of wires therein. In an embodiment, the receptacle may include a plurality of apertures for receiving the plurality of ferrules therein.

In a further embodiment, an electrical plug and wire assembly is provided comprising a wire having a metallic, terminal portion protruding from an insulator. A plug is provided having a first housing half and a second housing half for capturing the wire therebetween. The housing includes a body for capturing the wire therebetween, the housing including a body for capturing at least a portion of the insulator and a ferrule for capturing at least a portion of the metallic, terminal portion of the wire so that the terminal portion is exposed for electrical connection thereto. A first retention member is provided and protrudes from the ferrule. In an embodiment. the plus may be received by a receptacle having an aperture extending between a rear face and a front face and a contact mounted adjacent to the aperture for contacting the terminal portion of the wire. In an embodiment, the receptacle may include a hinged flap for enclosing the aperture at the rear face and a second retention member adjacent the aperture for coupling the first retention member in order to lock the plug within the aperture of the receptacle.

In an embodiment each plug housing half may include a major surface having a channel for receiving the wire and terminal therein. In an embodiment, a hole may be formed in the ferrule and in communication with the channel in order to receive a terminal portion of the wire formed at approximately 90° from the wire received in the channel. In an embodiment, the first half may include the body having the ferrule extending therefrom and the second half may include a body corresponding to the body of the first half so that upon mating of the halves the ferrule protrudes beyond each body and the major surface having the wire mounted in the channel is exposed adjacent to body of the second half. In an embodiment, each channel may include a wire receiving portion and an insulator receiving portion wherein the diameter of the insulator receiving portion is greater than the wire receiving portion. In an embodiment, the first retention member may include a ramped protrusion. In an embodiment, the second retention member may include a tab so that when the ferrule is inserted in the aperture the protrusion slides past the tab and locks behind the tab restricting the plug from being removed from the receptacle. In an embodiment, the contact is stamped and formed having a right angle tail protruding through passage in the receptacle so that the receptacle may be through-hole mounted to a host substrate.

In an additional embodiment, an electrical receptacle is provided comprising an aperture extending between a rear face and a front face for receiving a plug therein having a first retention member. A contact is provided mounted adjacent the aperture. A hinged flap-seal for enclosing the aperture is provided at the rear face in order to impede the flow of liquid into the aperture from the rear face. A second retention member is provided adjacent the aperture for coupling with the first retention member in order to lock the plug within the aperture of the receptacle. In an embodiment, the flap includes a living hinge integrally formed with a housing forming the receptacle. In an embodiment, the aperture may include a generally rectangular shaped opening at the front face having a keying feature at one side and the second retention member protruding into the opening from the keying feature at the front face. In an embodiment, a contact may be mounted in the receptacle adjacent the aperture and have a right angle tail for protruding through the housing of the receptacle in order to provide a mounting tail.

In an additional embodiment, a method of connectorizing a wire is provided comprising the steps of stripping a wire to expose the metallic, terminal portion from an insulator surrounding the wire, mounting the wire to the first housing half so that the wire is received within the channel formed in the first housing half and the channel is provided within a body and a ferrule forming the first housing half and the insulator is received at the body and the terminal portion is received at the ferrule, mounting a second housing half over the first housing half in order to capture the wire therebetween and bonding the first housing half to a second housing half to form an assembled plug. In an embodiment, the first housing half may include an energy director formed parallel to the channel, the energy director facilitating the bonding of the first half to the second half. In an embodiment, the method may comprise the additional steps of bending an end of the wire at approximately a right angle and inserting the end into a hole formed at a tip of the ferrule in order to mount the wire to the first housing half. In an embodiment the second housing half may include a channel for receiving the insulator therein. In an embodiment, the method may further comprise the step of forming a kink in the wire in order to provide a strain relief feature.

In a further embodiment, the invention provides for an electrical plug and wire assembly comprising a wire having a metallic, terminal portion protruding from an insulator and an end of the wire is bent at approximately a right angle. A plug is provided including a housing having the wire mounted therein, the housing including a body and a ferrule protruding therefrom. The ferrule is provided having a major surface that is an external surface of the plug and a hole for receiving the end of the wire and the ferrule capturing at least a portion of the terminal portion of the wire at the major surface so that the terminal portion is exposed for electrical connection thereto and a first retention member protruding from the ferrule.

BRIEF DESCRIPTION OF THE DRAWINGS

For the purpose of facilitating and understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF A PRESENTLY PREFERRED EMBODIMENT

Figure 1:
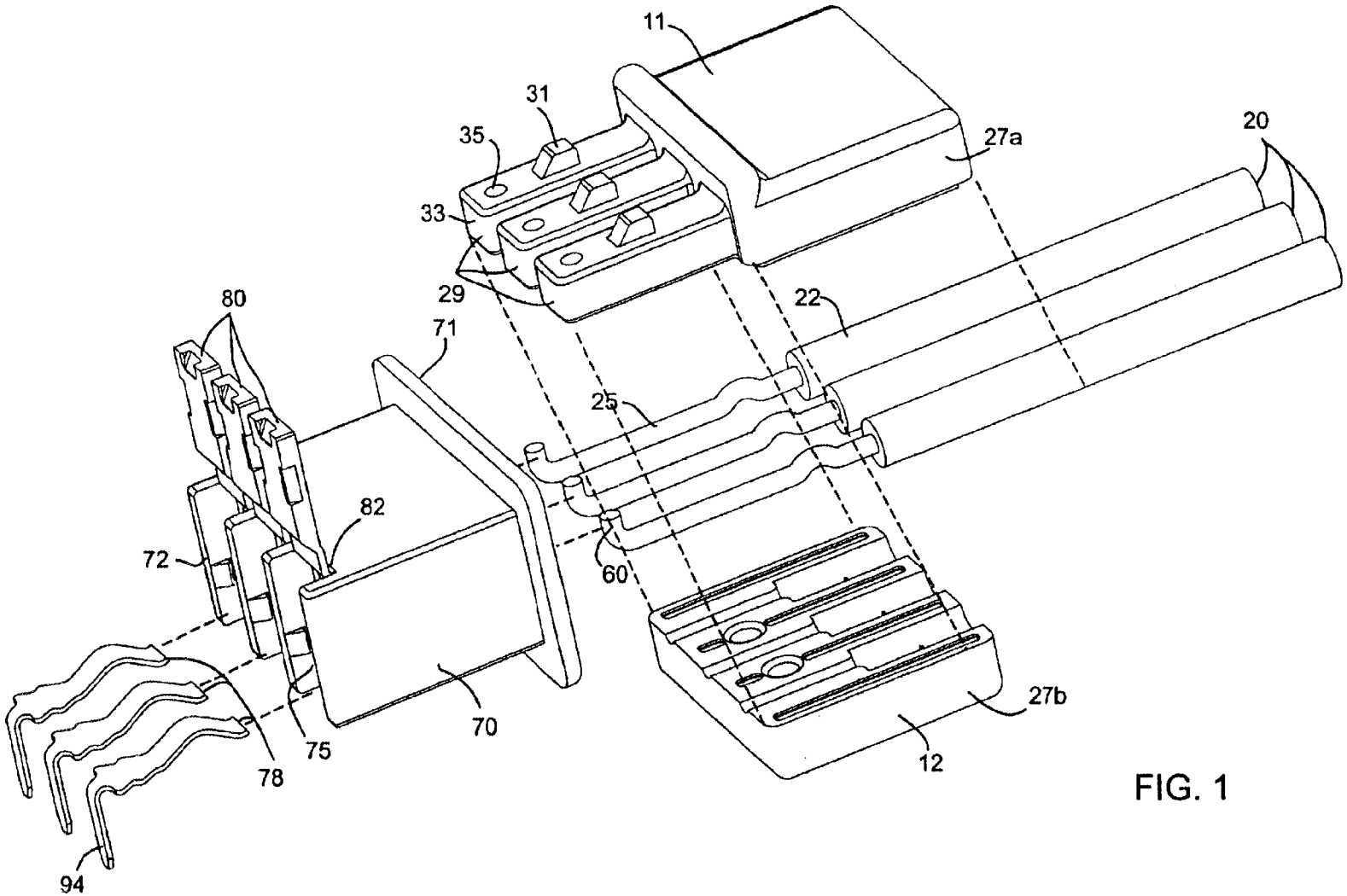
FIG. 1 is an exploded, rear perspective view of the receptacle and plug assembly of the present invention.

An embodiment of the present invention may be understood with reference to FIGS. 1–7. A first housing half 11 and a second housing half 12 form a plug 15 (see FIGS. 3 and 4). Captured between the first housing half 11 and the second housing half 12 are a plurality of wires 20. Each wire 20 is formed of an insulator 22 that is stripped to expose a terminal portion 25 of the wire. In a preferred embodiment, the wire may be 18 gage solid copper. The first housing half 11 includes a body 27*a* (see FIGS. 1 and 2). The second housing half 12 includes a corresponding body 27*b* that in a preferred embodiment, has a shape identical to the body 27*a* of the first housing half 11. The first housing half body 27*a* also includes a plurality of ferrules 29 protruding therefrom. Each ferrule protrudes from the body 27*a* and includes a first retention member 31 protruding therefrom and a tip 33 having a hole 35 formed therein.

Figure 2:
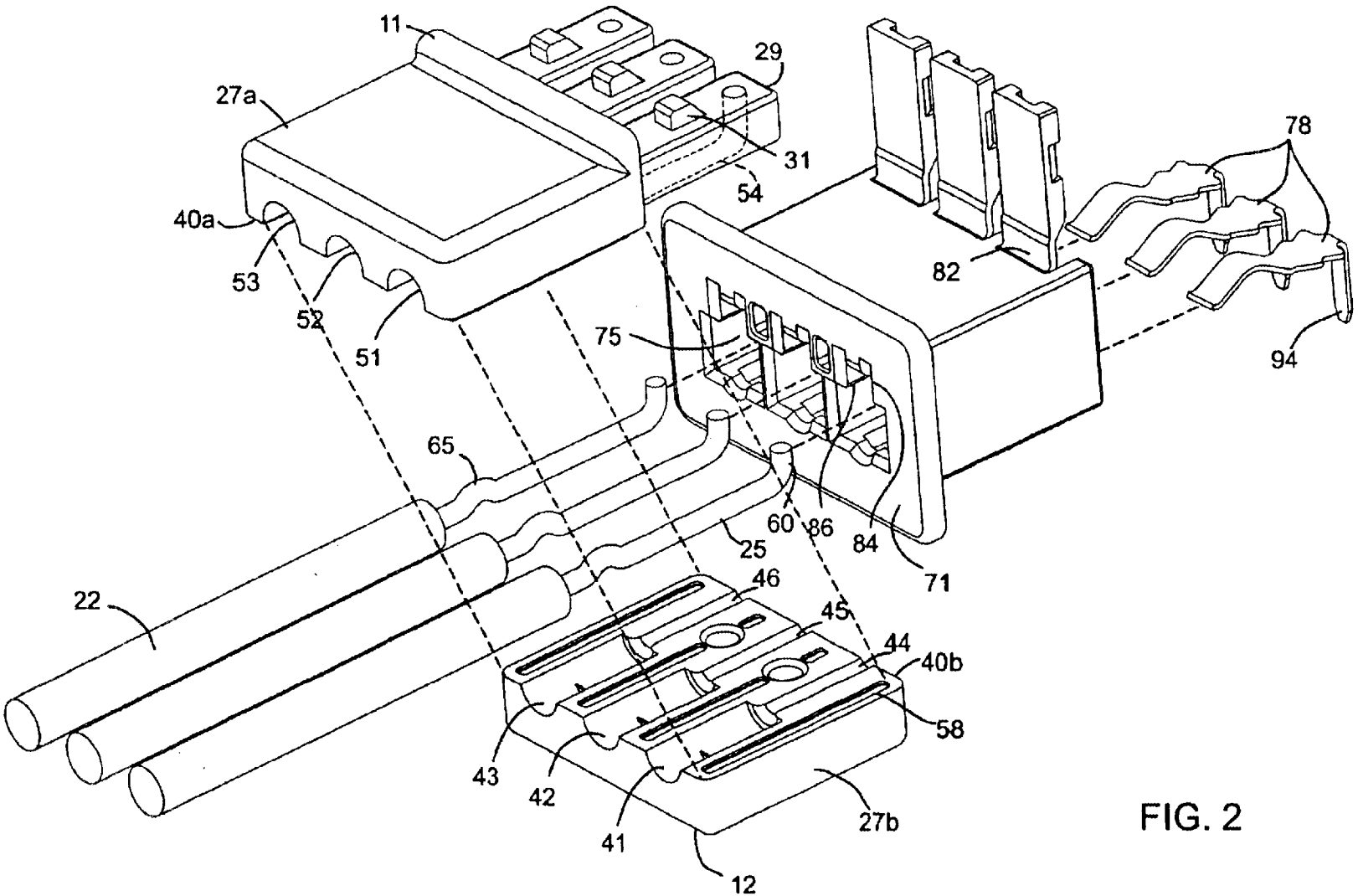
FIG. 2. is an exploded, front perspective view of FIG. 1.
Figure 3:
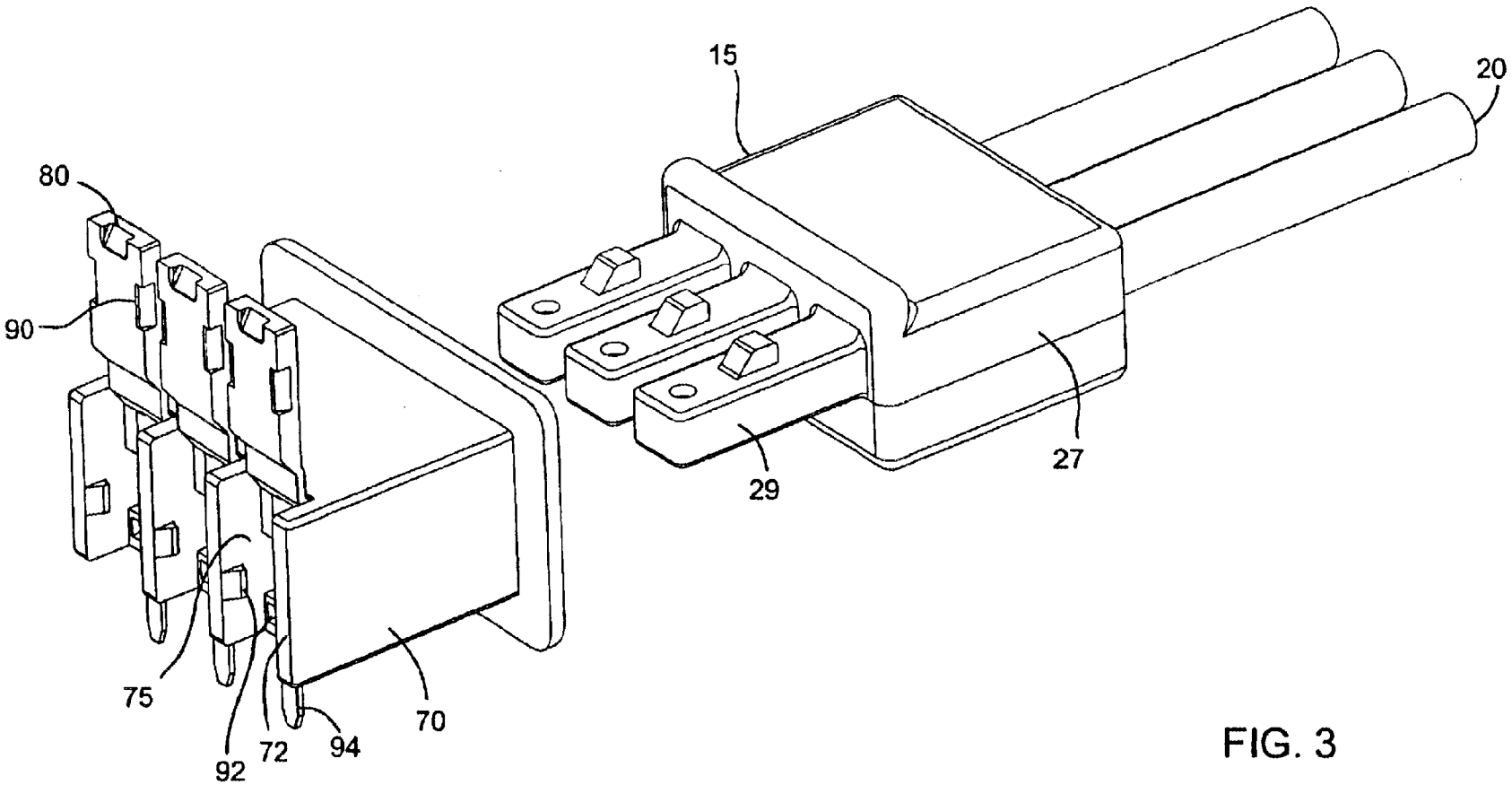
FIG. 3 is a rear perspective view of the assembled plug prior to mating with the receptacle.
Figure 4:
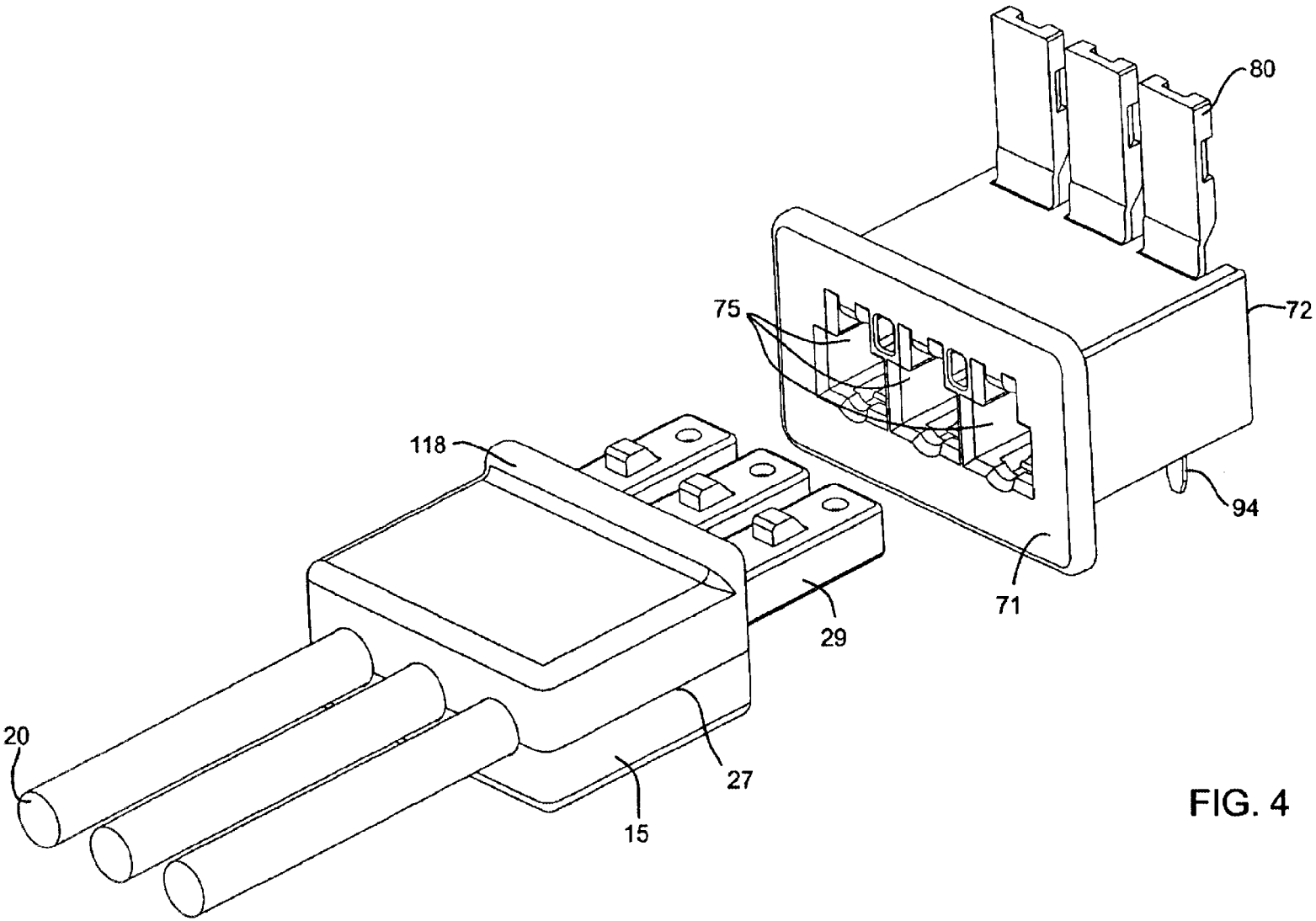
FIG. 4 is a front perspective view of the assembly of FIG. 3.
Figure 6:
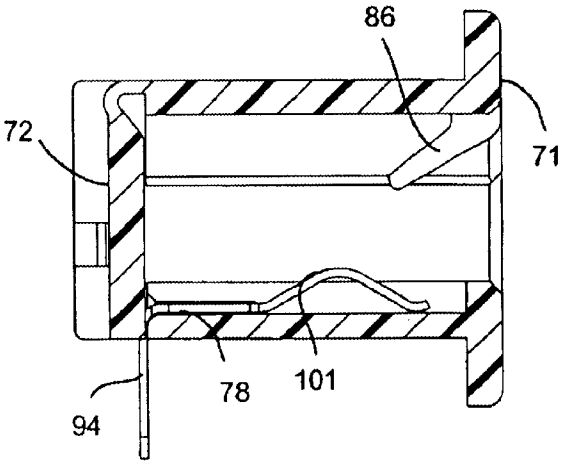
FIG. 6 is a side elevation cutaway view of FIG. 5 taken at line 6—6.
Figure 5:
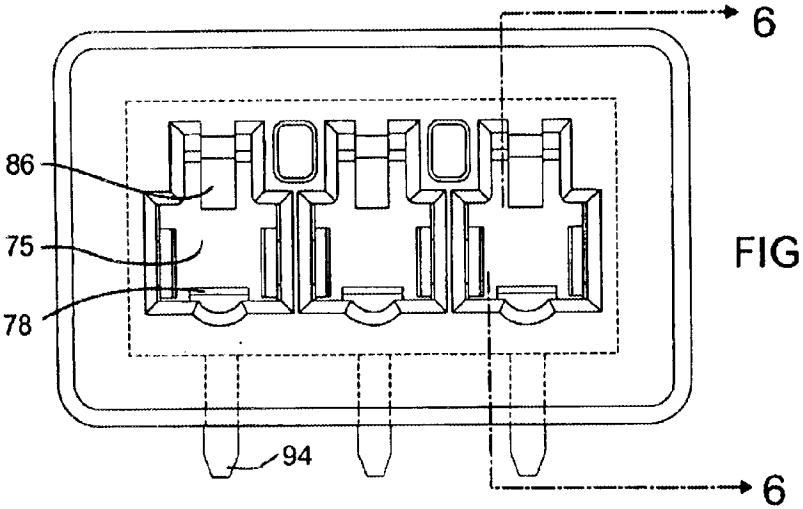
FIG. 5 is a front elevation view of a receptacle of the present invention.

Each housing half 11, 12 includes a major surface 40 from which channels 41, 42, 43, 44, 45 and 46 are formed in the second housing half 27*b* (see FIG. 2). Corresponding channels 51, 52, 53 and 54 are formed in major surface 40 in the first housing half 27*a*. In a preferred embodiment the housing halves 27*a*, 27*b* are formed of a polymer material such as Nylon. UL 94V-0. Each housing half 27*a*, 27*b* also includes a welding feature such as energy directors 58 (see FIG. 2) formed of protrusions formed parallel to the channels 41, 42, 43, 44, 45, and 46. In a preferred embodiment, the channels 41, 42, 43 and 51, 52, 53 are insulator receiving portions and have a larger diameter than the channels 44, 45, 46 and 54 which are wire receiving portions. Although the embodiment shown in the FIGS. 1–7 include three ferrules 29, three wires 20 and three channels 41, 42, 43 for receiving those three wires 20, the present invention may include any number of ferrules, wires and channels. In a preferred embodiment, the ferrules and terminal contacts therein are placed on 0.180 inch centers. In an embodiment, the plug 15 may receive a wire harness that has individual wire exposed at the mating end. In an embodiment, each wire includes an end 60 which is bent at approximately 90° within the hole 35 of the ferrule 29. The terminal portion 25 of each wire 20 is received within the channel 54 within the ferrule 29. Each channel 54 is semicircular in shape to receive approximately half of the cylindrical terminal portion 25 of the wire 2 (see FIG. 7).

A method of assembling the plug 15 will be described as follows: the wires 20 are mounted to the first housing half 27*a* so that each end 60 is inserted within the hole 35 at the tip 33 of the ferrule 29. Simultaneously, the terminal portions 25 are received within semi-circular channels 54 (FIG. 2) of the ferrules and the insulator 20 is received within the semi-circular channels 51, 52, 53 of the body 27*a* of the first housing half 11. The second housing half 11 is then mounted to the first housing half 11, so that each major surface 40*a*, 40*b* is abutting and sandwiching the wires 20 therebetween. In a preferred embodiment the wires include a crimp 65 which frictionally engages the channel 46 in order to provide a strain relief of the terminal portion 25 of the wire within the housing halves 11, 12. When the first housing half 11 and the second housing half 12 are assembled to each other, the energy directors 58 of the first housing half 11 and second housing half 12 are abutting. In an embodiment, where the second housing half 12 energy director 58 is a protrusion, the first housing half 11 energy director may be a recess for receiving the protrusion therein. In a preferred embodiment, the first housing half 11 is bonded to the second housing half via ultrasonic welding. Upon application of ultrasonic energy, the energy director 58 receives the ultrasonic energy and melts in order to bond the first housing half 11 to the second housing half 12 forming a uniform body 27 (see FIG. 3 and FIG. 4).

In alternate embodiments, the housing halves 11, 12 may be secured by other known means such as adhesives, snap fitting portions, mechanical means and/or use of fasteners. In a further alternate embodiment, the plug housing 15 may be insert molded around the terminal portion of the wires 20. In an embodiment, to accommodate the field termination of the wires 20, the use of housing halves 11, 12 being placed around the terminal portion 25 of the wires can be quickly and easily accomplished in the field. Therefore, it may be understood that the plug 15 of the present invention provides for a quick and easy method of transforming bare wires 20 to a robust and pluggable plug assembly which can be mated to a receptacle 70.

The receptacle 70 includes a front face 71 and a rear face 72. Apertures 75 (see FIG. 4) extend between the front face 71 and rear face 72. The apertures 75 include contacts mounted therein. The contacts 78 may be insert molded, stitched or snapped in place to the receptacle 70. The rear face 72 of the receptacle 70 includes hinged flaps 80. It may be understood that while the embodiments disclosed in FIGS. 1–7 include three apertures 75 having three contacts 78 mounted therein and three hinged flaps 80 for enclosing the rear face 72, other embodiments may have any number of apertures, contacts and hinged flaps. In a preferred embodiment, the hinges 80 include a living hinge 82 which in integrally formed between the rear face 72 of the receptacle 70 and the hinged flaps 80. In an embodiment, the hinged flaps 80 my serve as a flap-seal in order to seal the real face 75 from liquids such as pitch or potting material from leaking into the apertures 75 of the receptacle 70. In an embodiment, hinged flaps 80 include tabs 90 for engaging bumps 92 formed on the rear face 72 of the receptacle 70 (see FIG. 3). When the hinged flaps 80 are rotated downward into the closed position, the tabs 90 engage the bumps 92 and frictionally slide past in order to snap into a locked closed position to enclose the apertures 75 at the rear face 72 of the receptacle 70.

Figure 7:
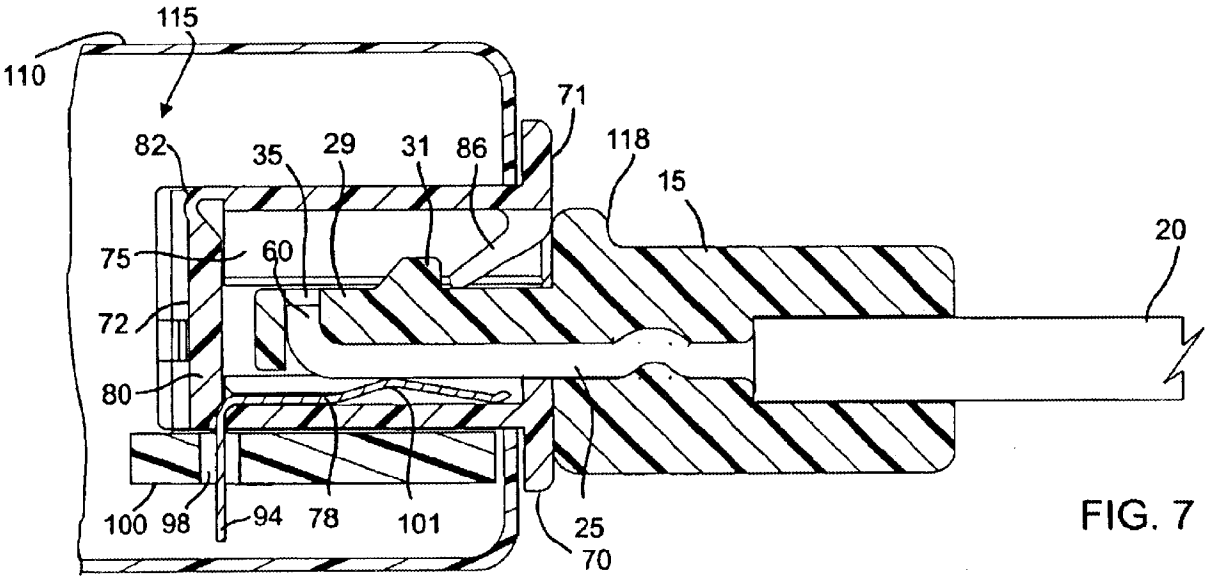
FIG. 7 is a side elevation cutaway view of the receptacle of FIG. 6 mounted to a host device and having a plug received therein.

The front face 71 includes openings for the apertures 75 including keying features 84 having a second retention member 86 protruding therefrom (see FIG. 2 and FIG. 7). In an embodiment, the second retention member 86 is a finger that protrudes down into the aperture 75 so that when the plug 15 is mated with the receptacle 70, the ferrule 29 first retention member 31, formed of a ramped protrusion, will abut against the second retention member 86 and slide past. The second retention member 86 may be resilient so that it may flex upward, upon abutment by the first retention member 31. Once the ferrule 29 is fully inserted, the second retention member 86 will spring back to its original position and abut against a vertical side of the first retention member 31 in order to retain and lock the ferrule 29 within the aperture 75; therefore locking the entire plug assembly 15 to the receptacle 70 (as shown in FIG. 7). Upon insertion of the plug 15, a ridge 118 formed along the top of the body 27 abuts against the front face 71 of the receptacle 70 and provides the plug in its fully mated position within the receptacle 70. In an embodiment, the plug may be mated only one time within the receptacle 70, as it is locked in place by the first and second retention members 31, 86 after the first insertion. In an alternate embodiment, retention members may be provided that allow for multiple insertions and removals of the plug 15. The terminal portion of the wire 25 is exposed at the major surface 40*a* of the ferrule 29 so that it may make electrical connection with the contact 78 within the receptacle 70.

In a preferred embodiment, the contacts 78 are stamped and formed having a right angle tail 94 to be received by a through-hole 98 formed in a printed circuit board 100 (see FIG. 7). The contact 78 also includes a curved portion 101 for making contact with the terminal portion 25 of the wire 20 upon insertion of the ferrule 29 within the aperture 75 of the receptacle 70. As shown in FIG. 7, a host device 10, for example a ballast fixture having a metal housing, includes a printed circuit board 100. The receptacle 70 is mounted to the host device by having the contact tail 94 soldered within the through-hole 98. The hinged flap 80 is closed in order to seal the rear face 72. After the installation, in an embodiment, the host device 100 may be potted or filled with pitch in area. However, due to the enclosure of the rear face 72 of the receptacle 70 with the hinged flap seal 80, the pitch will not penetrate the aperture 75 and the electrical connection between the wire 20 and the contact 78 will not be degraded or interfered with. In an embodiment, the receptacls is formed so that it is fluid resistant on three sides to allow a manufacturer of the host device to fill the ballast with pitch without the intrusion of fluid in the connector cavity or apertures 75.

The matter set forth in the foregoing description and accompanying drawings is offered by way of illustration only and not as a limitation. While particular embodiments have been shown and described it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A combination plug and receptacle assembly comprising:

a plug having a first housing half and a second housing half for capturing therebetween a metallic wire having an insulator, one of the housing halves including a body for capturing the insulator and a ferrule for capturing the wire so that the wire is exposed for electrical connection therefrom and the ferrule having a first retention member; and a receptacle having an aperture for receiving the plug therein, the aperture extending between a rear face and a front face, a contact mounted adjacent the aperture, a hinged flap for enclosing the aperture at the rear face and a second retention member adjacent the aperture for coupling with the first retention member in order to lock the plug within the aperture of the receptacle.

2. The assembly of claim 1 wherein the first half includes the body having the ferrule extending therefrom and the second half includes a body corresponding to the body of the first half so that upon mating of the halves, the ferrule protrudes beyond each body and the major surface having the wire mounted in the channel is exposed adjacent the body of the second half.

3. The assembly of claim 1 wherein the flap includes a living hinge connecting it to the rear face.

4. The assembly of claim 1 wherein the flap includes tabs for engaging bumps on the rear face in order to lock the flap in a closed and sealed position.

5. The assembly of claim 1 wherein plug includes a ridge formed on the body to abut the front face when the plug is inserted in the receptacle.

6. The assembly of claim 1 wherein the second retention member includes a tab so that when the ferrule is inserted in the aperture a ramped protrusion protruding from the first retention member and slides past the tab and locks behind the tab restricting the plug from being removed from the receptacle.

7. The assembly of claim 1 wherein the first retention member includes a ramped protrusion.

8. The assembly of claim 7 wherein the second retention member includes a finger so that when the ferrule is inserted in the aperture the protrusion slides past the finger and locks behind the finger restricting the plug from being removed from the receptacle.

9. The assembly of claim 1 wherein the contact is stamped and formed having a right angle tail protruding through an opening in the receptacle so that the receptacle may be through-hole mounted to a host substrate.

10. The assembly of claim 9 wherein the host substrate includes liquid pitch dispersed therein and the flap sealing the aperture from the pitch.

11. The assembly of claim 1 wherein each plug housing half includes a major surface having a channel for receiving the wire and insulator therein.

12. The assembly of claim 11 wherein a hole is formed in the ferrule and is in communication with the channel in order to receive a terminal portion of the wire formed at approximately 90° from the wire received in the channel.

13. The assembly of claim 11 wherein each housing half includes welding features to enhance the welding of the first half to the second half.

14. The assembly of claim 13 wherein the welding feature is an energy director for ultrasonically welding the first and second halves.

15. The assembly of claim 11 wherein each channel includes a wire receiving portion and an insulator receiving portion wherein the diameter of the insulator receiving portion is greater than the wire receiving portion.

16. The assembly of claim 15 wherein the wire is crimped between the wire receiving portion and the insulator in order to act as a strain relief for the wire.

17. An electrical plug and wire assembly comprising:

a wire having a metallic, terminal portion protruding from an insulator;

a plug having a first housing half and a second housing half for capturing the wire therebetween and forming a housing including a body for capturing at least a portion of the insulator and a ferrule for capturing at least a portion of the metallic, terminal portion of the wire so that the terminal portion is exposed for electrical connection thereto;

a receptacle for receiving the plug and the receptacle having an aperture extending between a rear face and a front face and a contact mounted adjacent the aperture for contacting the terminal portion of the wire; and a first retention member protruding from the ferrule.

18. The assembly of claim 17 wherein the receptacle includes a hinged flap for enclosing the aperture at the rear face and a second retention member adjacent the aperture for coupling with the first retention member in order to lock the plug within the aperture of the receptacle.

19. The assembly of claim 17 wherein each plug housing half includes a major surface having a channel for receiving the wire and terminal therein.

20. The assembly of claim 19 wherein a bore is formed in the ferrule and in communication with the channel in order to receive a terminal portion of the wire formed at approximately 90° from the wire received in the channel.

21. The assembly of claim 17 wherein the first retention member includes a ramped protrusion.

22. The assembly of claim 17 wherein the body includes a first body having the ferrule extending therefrom and the second half includes a second body corresponding to the body of the first half so that upon mating of the halves the ferrule protrudes beyond each of the first and second body and the ferrule having a major surface exposed adjacent the second body of the second half so that the wire is exposed at the major surface and mounted in a channel.

23. The assembly of claim 22 wherein the channel includes a wire receiving portion and an insulator receiving portion wherein the diameter of the insulator receiving portion is greater than the wire receiving portion.

24. An electrical receptacle comprising:

an aperture extending between a rear face and a front face for receiving a plug therein having a first retention member;

a contact mounted adjacent the aperture;

a hinged flap for enclosing the aperture at the rear face; and a second retention member adjacent the aperture for coupling with the first retention member in order to lock the plug within the aperture of the receptacle.

25. The receptacle of claim 24 wherein the flap includes a living hinge integrally formed with a housing forming the receptacle.

26. The receptacle of claim 24 wherein the aperture includes a generally rectangular shaped opening at the front face having a keying feature at one side and the second retention member protruding into the opening from the keying feature.

27. The receptacle of claim 24 wherein a contact is mounted in the receptacle adjacent the aperture and having a right angle formed for protruding through the housing of the receptacle in order to provide a mounting tail.

28. A method of connectorizing a wire comprising the steps of:

stripping a wire to expose the metallic, terminal portion from an insulator;

providing a plug comprising a first housing half including a ferrule having a first retention member integrally formed on the ferrule;

placing the wire within the first housing half of the plug so that the insulator is received within a channel formed in a body of the first housing half and the terminal portion is received in a bore of the ferrule formed in the first housing half, the terminal portion formed at approximately 90° and received in the bore;

mounting a second housing half over the first housing half in order to capture the wire therebetween; and bonding the first housing half to a second housing half to form the assembled plug wherein the assembled plug is mated to a receptacle having an aperture extending between a rear face and a front face and a contact mounted adjacent the aperture for containing the terminal portion of the wire.

29. The method of claim 28 further comprising the step of crimping the exposed wire and mounting a crimped portion in the channel in order to provide a strain relief.

30. The method of claim 29 further comprising the step of placing the mounted first half housing half and second housing half as a plug assembly in an ultrasonic welding plate; and applying ultrasonic energy to the plug assembly in order to ultrasonically weld the first and second housing halves together.

31. The method of claim 29 further comprising the steps of inserting the plug within the receptacle so that a first retention member of the plug frictionally engages a second retention member of the receptacle and the second retention member compresses to allow the first retention member to slide past and become locked adjacent the second retention member.

32. A wire connector comprising:

a housing formed of a polymer material having a body and a ferrule having an exposed major surface having a channel formed therein;

a wire having a metallic, terminal portion protruding from an insulator and the wire mounted within the channel of the housing so that the terminal portion is exposed at the major surface;

a bore formed in the ferrule in communication with the channel and a portion of the terminal portion formed at approximately 90° received in the bore; and a retention member protruding from the ferrule for retaining the ferrule within a receptacle when connector is inserted therein.

33. An electrical plug and wire assembly comprising:

a wire having a metallic, terminal portion protruding from an insulator;

a plug having a first housing half and a second housing half for capturing the wire therebetween and forming a housing including a body for capturing at least a portion of the insulator and a ferrule for capturing at least a portion of the metallic, terminal portion of the wire so that the terminal portion is exposed for electrical connection thereto;

a first retention member protruding from the ferrule;

each plug housing half includes a major surface having a channel for receiving the wire and terminal therein; and a bore is formed in the ferrule and in communication with the channel in order to receive a terminal portion of the wire formed at approximately 90° from the wire received in the channel.

34. An electrical plug and wire assembly comprising:

a wire having a metallic, terminal portion protruding from an insulator;

a plug having a first housing half and a second housing half for capturing the wire therebetween and forming a housing including a body for capturing at least a portion of the insulator and a ferrule for capturing at least a portion of the metallic, terminal portion of the wire so that the terminal portion is exposed for electrical connection thereto;

a first retention member protruding from the ferrule; and the plug is received by a receptacle having an aperture extending between a rear face and a front face and a contact mounted adjacent the aperture for contacting the terminal portion of the wire.

35. An electrical plug and wire assembly comprising:

a wire having a metallic, terminal portion protruding from an insulator;

a plug having a first housing half and a second housing half for capturing the wire therebetween and forming a housing including a body for capturing at least a portion of the insulator and a ferrule for capturing at least a portion of the metallic, terminal portion of the wire so that the terminal portion is exposed for electrical connection thereto;

a first retention member protruding from the ferrule;

the plug is received by a receptacle including a hinged flap for enclosing an aperture at a rear face and a second retention member adjacent the aperture for coupling with the first retention member in order to lock the plug within the aperture of the receptacle.

* * * * *